US007002543B2

(12) United States Patent
Miyajima et al.

(10) Patent No.: US 7,002,543 B2
(45) Date of Patent: Feb. 21, 2006

(54) METHOD FOR DRIVING ACTIVE MATRIX TYPE LIQUID CRYSTAL DISPLAY

(75) Inventors: Yasushi Miyajima, Gifu (JP); Ryoichi Yokoyama, Ogaki (JP)

(73) Assignee: Sanyo Electric Co., Ltd., (JP)

( * ) Notice: Subject to any disclaimer, the term of this patent is extended or adjusted under 35 U.S.C. 154(b) by 127 days.

(21) Appl. No.: 10/113,097

(22) Filed: Mar. 28, 2002

(65) Prior Publication Data

US 2002/0140661 A1 Oct. 3, 2002

(30) Foreign Application Priority Data

Mar. 30, 2001 (JP) ..... 2001-101768

(51) Int. Cl.
*G09G 3/28* (2006.01)

(52) U.S. Cl. ..... 345/94; 345/99; 345/208; 345/211

(58) Field of Classification Search ..... 345/92, 345/94–96, 208–210, 89, 99, 211, 212, 213
See application file for complete search history.

(56) References Cited

U.S. PATENT DOCUMENTS 4,675,667 A * 6/1987 Nakamura et al. ..... 345/92
4,779,085 A * 10/1988 Mizutome et al. ..... 345/92
5,426,447 A * 6/1995 Lee ..... 345/103
5,694,145 A 12/1997 Kondo et al. ..... 345/90
5,724,057 A * 3/1998 Kimura et al. ..... 345/89
5,877,736 A * 3/1999 Imajo et al. ..... 345/89
6,229,515 B1 * 5/2001 Itoh et al. ..... 345/103
6,369,786 B1 * 4/2002 Suzuki ..... 345/77
6,424,328 B1 * 7/2002 Ino et al. ..... 345/87
6,486,864 B1 * 11/2002 Nakajima et al. ..... 345/92

FOREIGN PATENT DOCUMENTS

| | | |
|---|---|---|
| EP | 0 678 848 | 10/1995 |
| EP | 0 737 957 | 10/1996 |
| EP | 1 139 329 | 10/2001 |
| JP | 6-337657 | 12/1994 |
| JP | 10-153761 | 6/1998 |

OTHER PUBLICATIONS

European Search Report.
Notice of Grounds for Rejecction of Korean Patent Application No. 10-2002-0017339 dated Jan. 29, 2004.

* cited by examiner

*Primary Examiner*—Amr A. Awad
(74) *Attorney, Agent, or Firm*—Cantor Colburn LLP

(57) ABSTRACT

In an active matrix type liquid crystal display, during a non-display period such as the horizontal blanking interval or the vertical blanking interval wherein no pixel TFT is selected, the voltage of the opposing electrode is changed so that the power consumption is reduced with application of sufficient voltage to the liquid crystal and without increasing the amplitude of the display data. Also, a change alleviating voltage VM is applied during the change in the opposing electrode voltage to data lines for supplying display data to each of pixel TFTs during the display period, in order to prevent changes in the potential of the data lines caused by the change in the opposing electrode voltage and large reverse bias from being loaded to switches Hsw for outputting display data to the data lines.

14 Claims, 5 Drawing Sheets

METHOD FOR DRIVING ACTIVE MATRIX TYPE LIQUID CRYSTAL DISPLAY

BACKGROUND OF THE INVENTION

1. Field of the Invention

The present invention relates to method of driving an active matrix type liquid crystal display, and more particularly to a method of alternating drive of opposing electrodes in active matrix type liquid crystal displays.

2. Description of the Related Art

An active matrix type liquid crystal display (LCD) comprises a switch element such as a thin film transistor (hereinafter referred to as a "TFT") in each pixel, and display data is supplied to each pixel electrode via the switch element so that the alignment of liquid crystal in each pixel is controlled by the pixel electrode and an opposing electrode (common electrode) provided to oppose the pixel electrode with the liquid crystal in between.

Although a liquid crystal display inherently has a low power consumption, further reduction in the power consumption is strongly demanded in portable information devices or the like to which LCD displays are equipped, and, consequently, still further reduction in the power consumption of liquid crystal displays is desired.

If the liquid crystal drive voltage which is applied between the pixel electrode and the opposing electrode can be reduced, power consumption can be reduced. However, in order to reliably control the alignment of the liquid crystal, application of sufficient voltage to the liquid crystal is desired, and, thus, the applied voltage to the liquid crystal cannot be reduced significantly. Therefore, in a liquid crystal display, there is a need for some means that can reduce the power consumption without reducing the voltage applied to the liquid crystal and without degrading the display quality and reliability of the device.

SUMMARY OF THE INVENTION

The present invention was conceived to solve at least the problem mentioned above, and one object of the present invention is to provide an active matrix type liquid crystal display in which the power consumption is reduced and, at the same time, necessary and sufficient voltage can be applied to the liquid crystals.

In order to achieve at least the object mentioned above, according to the present invention, there is provided a method for driving an active matrix type liquid crystal display, wherein, in the active matrix type liquid crystal display, liquid crystal are sealed in between a first substrate and a second substrate; the first substrate comprises switching elements and pixel electrodes connected to the switching elements, both of which are provided in correspondence to pixels that are arranged in a matrix, selection lines for sequentially selecting the switching elements, and data lines for supplying display data to the switching elements that are connected; and the second substrate comprises an opposing electrode for controlling, along with each of the pixel electrodes on the first electrode, the liquid crystal, the method comprising the steps of periodically changing, in a predetermined period, the opposing electrode voltage which is applied to the opposing electrode, and applying a change alleviating voltage to the data lines when the opposing electrode voltage is changed According to another aspect of the present invention there is provided a drive circuit for an active matrix type display, wherein, in an active matrix type display, liquid crystal is sealed between a first substrate and a second substrate, the first substrate comprises switching elements and pixel electrodes connected to the switching elements, both of which are provided in correspondence to pixels that are arranged in a matrix, selection lines for sequentially selecting the switching elements, and data lines for supplying display data to the switching elements that are connected, and the second substrate comprises an opposing electrode for controlling, along with each of the pixel electrode on the first substrate, the liquid crystal. Such a drive circuit comprises an opposing electrode controller for periodically changing, in a predetermined period, the opposing electrode voltage which is applied to the opposing electrode; and a data line voltage controller for applying a change alleviating voltage onto the data lines during the change in the opposing electrode voltage.

In general, in an active matrix type liquid crystal display, a constant common voltage Vcom is applied to an opposing electrode and the polarity, with respect to the common voltage Vcom, of display data applied to each pixel electrode is periodically inverted in a predetermined period, to alternately drive the liquid crystals. In contrast, in the present invention, the voltage on the opposing electrode is also periodically changed, that is, alternately driven. Because of this, sufficient voltage can be ensured for application to the liquid crystal without increasing the amplitude of the display data in which the polarity with respect to a predetermined reference is periodically inverted. Moreover, by applying a change alleviating voltage to the data lines during when the opposing electrode voltage is changed, large changes in the potential of the data lines caused by capacity coupling and the change in the opposing electrode potential are both inhibited.

In an active matrix type liquid crystal display, the data lines formed on the first substrate are, in many cases, laid out to oppose the opposing electrode with the liquid crystals in between. Therefore, in the equivalent circuit, a parasitic capacitance is formed between the data line and the opposing electrode and is connected to the data line, and, in some cases, the potential on the data line may change in response to the change in the opposing electrode voltage when such a change occurs. In particular, the change in the opposing electrode voltage is executed during the non-selection period of the pixels such as the vertical blanking interval and horizontal blanking interval, but, because no pixel is selected during such these intervals, the data line is electrically separated from the display data source. As result, the potential of the data line tends to change in response to the change in the opposing electrode voltage.

With the recent trend for higher density mounting and lower voltage drive of liquid crystal display devices, the size and peak inverse voltage of the switching elements employed in the drive circuit of the display are becoming smaller. This trend also applies to the display data output switches for outputting display data to the data lines, which are provided between the display data source and the data lines. Therefore, if the potential on the data line is significantly changed because of the change in the opposing electrode potential, a large reverse bias will be loaded to the output switch, possibly causing disadvantages such as degradation of the output switches. In the present invention, on the other hand, even though the opposing electrode voltage is changed, the potential change on the data lines caused by the change in the opposing electrode potential is inhibited by applying a change alleviating voltage to the data lines when the opposing electrode voltage changes. Thus, it is possible to prevent the degradation of the display data output switches as described above.

Also, in the present invention, the change alleviating voltage is at the center voltage of the display data. With such a configuration, the degradation of the display data output switch can be reliably prevented without increasing the circuit loading. Moreover, because the polarity, with respect to the center voltage, of the display data which is output to the data lines is periodically inverted in a predetermined period, no delay in the inversion operation is caused and the display quality is not adversely affected, even if the voltage of the data lines is set at the center voltage when the pixels are not selected.

According to the present invention, in addition to the reduction in the power consumption through inversion of the voltage of the opposing electrode, the voltage change on the data lines when the opposing electrode voltage is changed is also reduced. Therefore, because unnecessary loading to the switches or the like for selecting a data line can be prevented, the possibility of display defects in the column direction can be reduced, display quality can be maintained, and device reliability can be improved.

DESCRIPTION OF PREFERRED EMBODIMENT

Figure 1:
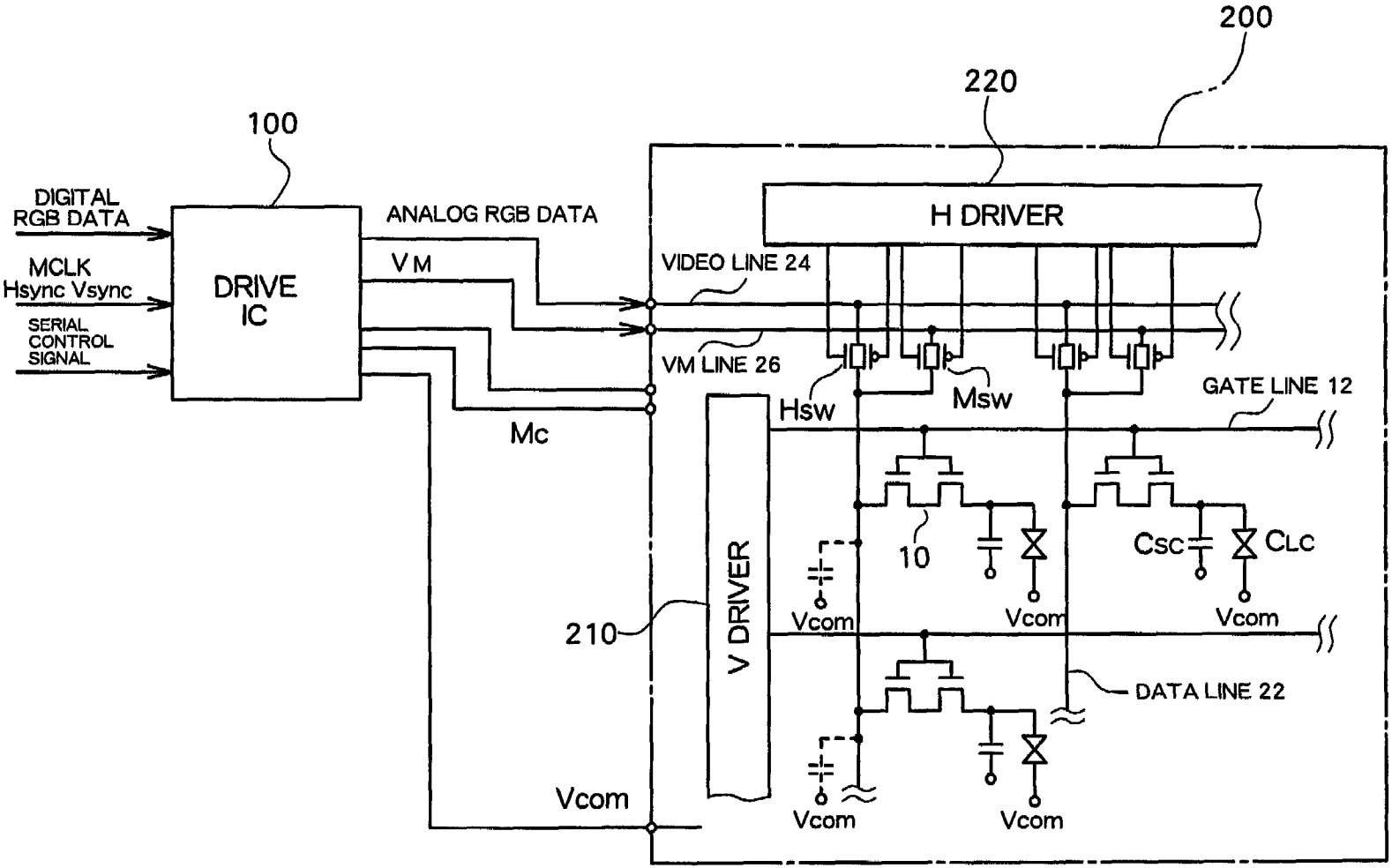
FIG. 1 is a schematic diagram showing a structure of a liquid crystal display according to an embodiment of the present invention.

The preferred embodiment of the present invention, hereinafter referred to simply as the embodiment, will now be described referring to the drawings.

Figure 2:
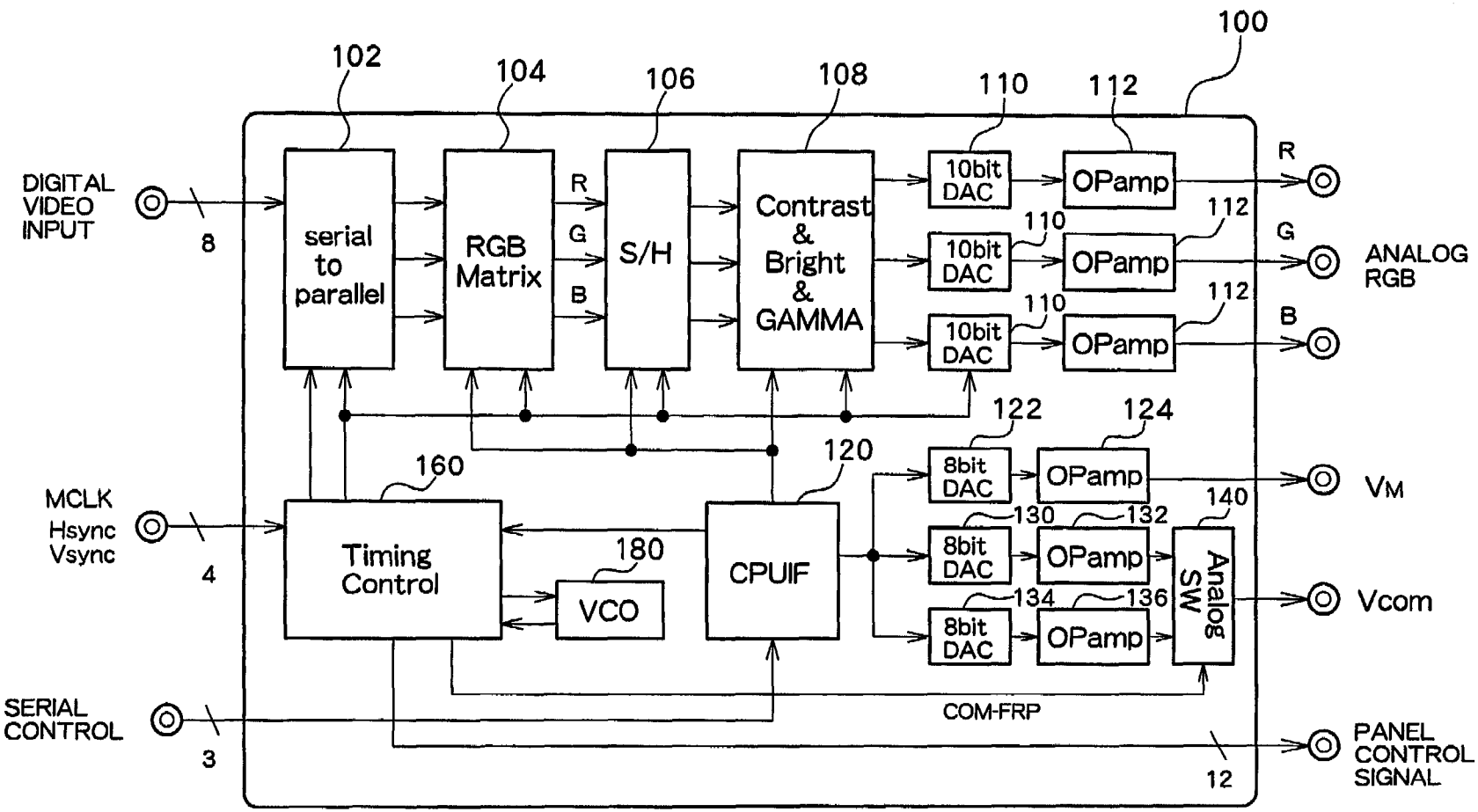
FIG. 2 is a diagram showing a specific structure of the drive IC 100 shown in FIG. 1.

FIG. 1 shows an overall structure of an active matrix type liquid crystal display according to the embodiment of the present invention. FIG. 2 shows a structure of a drive IC 100 for a display panel.

A liquid crystal display panel 200 is constructed by affixing a first substrate and a second substrate, each made of, for example, a glass substrate, with a predetermined gap between them and sealing liquid crystal in this gap. In an active matrix type liquid crystal display panel, pixel electrodes which are arranged in a matrix and switching elements 10 (here a TFT having a double gate structure) respectively connected to the pixel electrodes are formed on the first substrate, and, furthermore, selection lines (gate lines) 12 for sequentially selecting the TFTs and data lines 22 for supplying display data to the selected TFT are provided on the first substrate. The pixel electrode formed for each pixel is constituted by a liquid crystal capacitor Clc and an opposing electrode (common electrode) formed on the second substrate with the liquid crystal in between. The alignment of the liquid crystal is controlled based on the potential difference (alternating) between the display data voltage which is applied to the pixel electrode via each TFT 10 and the voltage on the opposing electrode, to effect display at each pixel. A storage capacitor Csc is provided in parallel to the liquid crystal capacitor Clc and connected to the pixel TFT 10, and maintains the pixel electrode voltage for one display period (one vertical scan period).

As the thin film transistor, a p-Si TFT which uses polycrystalline silicon (polysilicon, or "p-Si") as the active layer can be used to form not only the switch elements in the pixels, but also the transistors constituting the drivers.

In the example illustrating the present embodiment, p-Si TFTs are employed. As shown in FIG. 1, on the first substrate, pixel p-Si TFTs 10, a horizontal direction (H) driver 220, data output switches Hsw for controlling the timing for outputting data from the H driver 220, change alleviating voltage output switches (hereinafter referred to as "alleviating voltage output switch") Msw to be described later, and a vertical direction (V) driver 210 for sequentially outputting selection signals to the gate lines 12 are provided.

A drive IC 100 has a structure as shown in FIG. 2, and produces analog display data (R, G, and B data for color display), various timing signals for driving the V driver 210 and the H driver 220, opposing electrode voltage signal Vcom, etc., and outputs these to the liquid crystal display panel 200.

The structure of the drive IC 100 will now be described while referring to FIG. 2. A serial to parallel converter circuit 102 converts serially input signals such as, for example, 8-bit digital video signals into parallel data. An RGB matrix circuit 104 reproduces digital data of R, G, and B primary colors from the composite digital video data supplied from the converter circuit 102. A sample/hold circuit 106 samples the R, G, and B data and a correction circuit 108 applies contrast, brightness, and gamma corrections to each of the R, G, and B data streams and outputs each to a respective corresponding digital to analog converter circuit (DAC) 110 among a plurality of DACs 110. The R, G, and B video signals converted to analog signals at the DACs 110 are respectively amplified by one of a plurality of operational amplifiers 112, and are output to the video lines of the panel 200 as analog R, G, and B display data.

The drive IC 100 further comprises a CPU interface (I/F) circuit 120 and a timing controller (T/C) 160, and in some cases further comprises a built-in VCO 180. The T/C 160 produces and supplies a change alleviation control signal Mc to be described later and panel control signals (timings signals) necessary for operation of the V driver 210 and H driver 220 shown in FIG. 1, using a clock from the VCO 180 and based on the timing signals such as a master clock MCLK, a horizontal synchronization signal Hsync, and a vertical synchronization signal Vsync. Also, the T/C 160 produces and supplies timing signals necessary for each of the circuits for video signal processing system as described above. In addition, the T/C 160 forms an opposing electrode controller, and generates a Vcom inversion control signal COM-FRP for periodically inverting the opposing electrode voltage signal (Vcom) in a predetermined period and outputs COM-FRP to an analog switch 140 to be described below.

The I/F circuit 120 receives and interprets instructions transmitted from a CPU (not shown), and outputs an opposing electrode driving signal (Vcom) and a change alleviating voltage signal (VM) which are both digital signals. A DAC 122 converts the digital change alleviating voltage signal into an analog signal and outputs the converted analog signal to the display panel 200 after amplification by an operational amplifier 124. Digital opposing electrode voltage signals which are output from the I/F circuit 120 and have opposite polarities are respectively converted to analog signals by DACs 130 and 134, and amplified by a first operational amplifier 132 and a second operation alamplifier 136. Based on the Vcom inversion control signal from the T/C 160, the analog switch 140 alternately selects one of the first and second operational amplifiers 132 and 136. In this manner, the output from the selected one of the amplifiers 132 and 136 is supplied to the Vcom output terminal.

Figure 3:
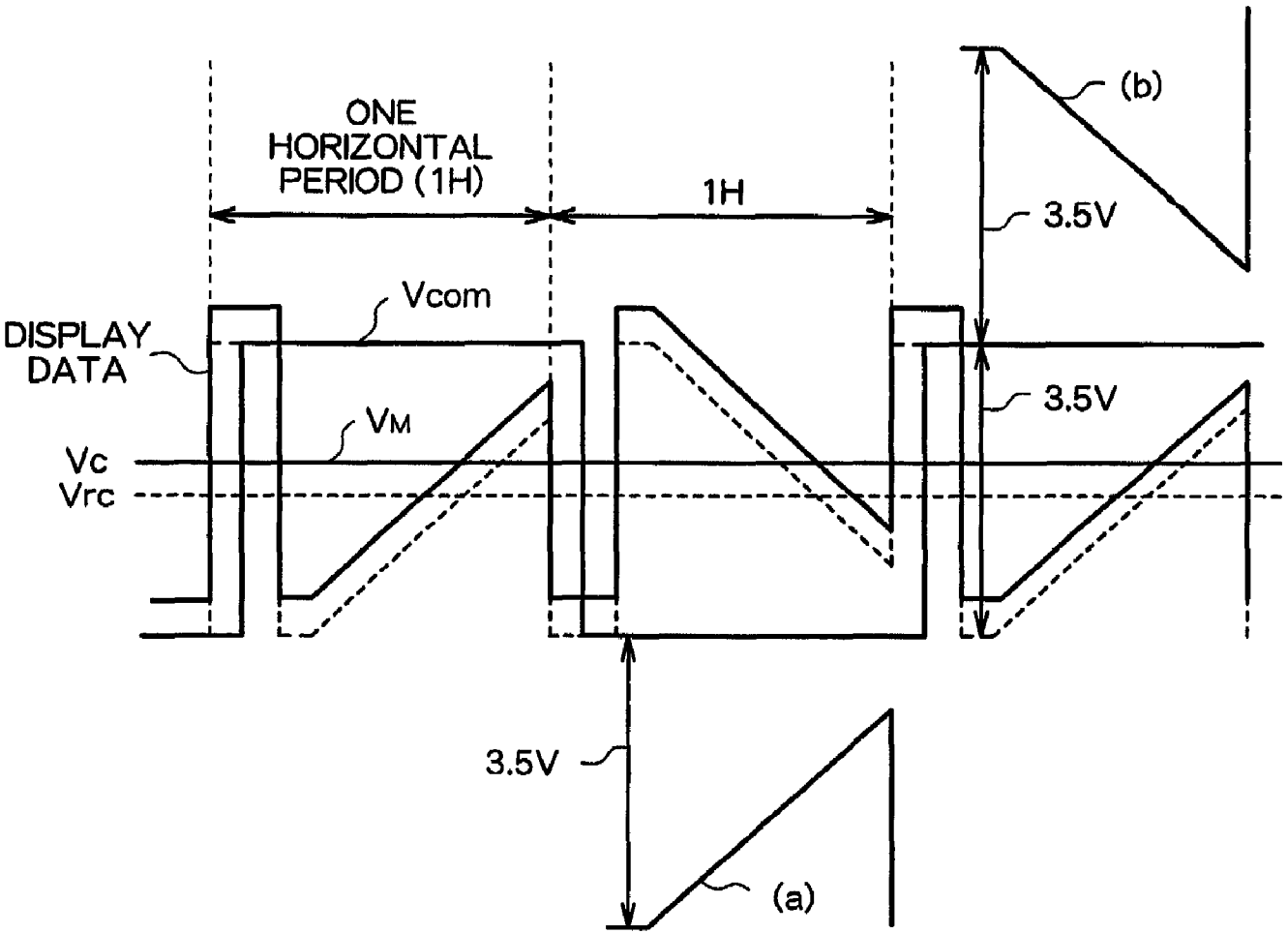
FIG. 3 is a waveform diagram for explaining changes in the display data when the opposing electrode voltage is changed.

FIG. 3 shows a relationship between the display data signal waveform on the data line and the voltage waveform on the opposing electrode. Based on the control signals from the T/C 160 as described above, the V driver 210 and H driver 220 shown in FIG. 1 are controlled, pixel TFTs 10 are sequentially selected in row units, and the display data signal which is output on the corresponding data line is applied to the pixel electrode via the selected TFT 10. In order to prevent persistence, the liquid crystal must be alternately driven by periodically inverting the polarity of the applied voltage in a predetermined period. In the embodiment, a so-called line inversion drive is employed in which the voltage level of the display data is inverted every horizontal scan period (1H). Furthermore in the subsequent frame, an opposite polarity is applied on the same line. With such line inversion drive, the potential at a predetermined position changes on a data line changes as shown in FIG. 3, and the polarity of the display data is inverted with respect to a video center voltage Vc every 1H.

In the example of the embodiment, as shown in FIG. 3, in addition to the 1H inversion drive of the display data as described above, the opposing electrode voltage (Vcom) is also periodically inverted. As described above, liquid crystal is driven by a potential difference between the potential of the opposing electrode and the potential of the display data which are written to each of the pixel electrodes. Normally, the opposing electrode voltage is fixed at a video center voltage Vc, but by inverting the opposing electrode potential, for example, every 1H, similar as for the display data, it is possible to apply the same voltage to the liquid crystal as when the opposing electrode voltage is fixed at Vc, even when the amplitude of the display data signal is reduced. This configuration is therefore useful in view of reduction in the power consumption of the device.

Such inversion of the opposing electrode voltage is performed during a non-display period, such as the horizontal blanking interval within one horizontal scan period or the vertical blanking interval within one vertical scan period. The reference voltage for the inversion is the center voltage Vrc of the voltage which is actually applied to the liquid crystal.

During a non-display period, in general, the outputs from the V driver 210 and form the H driver 220 are stopped. Data output switches Hsw are provided between the H driver 220 and the data lines 22, and these switches are controlled to be switched off during the non-display period. Therefore, during the non-display period, all data lines 22 are electrically separated. Also, at the liquid crystal display panel 200, the data lines 22 are formed on the first substrate to align with the pixel electrodes, and, in many cases, parasitic capacitances are created between the data lines 22 and the opposing electrode on the second substrate, with the liquid crystal in between. Therefore, if the opposing electrode voltage Vcom is inverted when these data lines 22 are electrically separated, capacity coupling is generated and the potentials of the data lines 22 tend to change in response to the opposing electrode voltage.

The waveforms (a) and (b) as shown in FIG. 3 illustrate the potential of a data line 22 which is changed in response to the change in the opposing electrode voltage. For example, if the amplitude of inversion of the opposing electrode voltage is 3.5 V, when the opposing electrode voltage is reduced, the potential at the data line 22 is rapidly reduced by 3.50 V. In contrast, when the opposing electrode voltage is increased, the potential of the data line 22 is also increased by 3.5 V. In other words, the amplitude of the potential at the data line 22 is increased by the amount of change of the opposing electrode voltage (for example, −2.25 V~8.25 V) compared to the original amplitude of the display data signal (for example, 1.75 V~5.25 V).

Figure 4A:
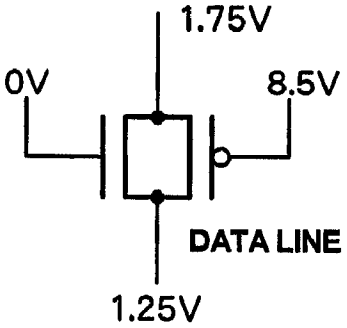
FIGS. 4A, 4B, 4C, 4D, 4E and 4F are diagrams for explaining reverse bias applied to horizontal switches Hsw.
Figure 4B:
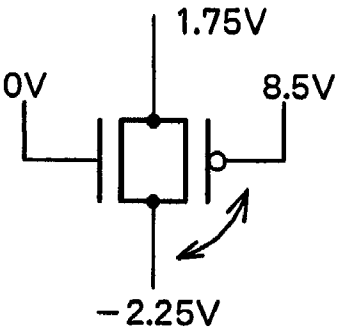

The switches Hsw are formed from a p-ch type TFT and an n-ch type TFT with the source of the p-ch type TFT connected to the drain of the n-ch type TFT and the source of the n-ch type TFT connected to the drain of the p-ch type TFT. During the non-display period, an off voltage is applied to the gates of the two TFTs. FIGS. 4A through 4F show conditions of the switch Hsw when it is controlled to be switched off. When the potential of data line 22 is changed by the change in the opposing electrode voltage, as shown by (a) in FIG. 3, the potentials at each section of the switch Hsw transition from the state shown in FIG. 4A to the state shown in FIG. 4B. In the p-ch type TFT of the switch Hsw, the reverse bias applied between the gate and drain (data line side) is 7.25 V in FIG. 4A, which shows a state before the opposing electrode voltage is changed, but is 10.75 V after the voltage change, as shown in FIG. 4B. When, on the other hand, the potential of data line 22 is changed as shown by (b) in FIG. 3, the reverse bias between the gate and the source (data line side) of the n-ch type TFT of the switch Hsw is 4.75 V before the voltage change, as shown in FIG. 4D, but is 8.25 V after the voltage change, as shown in FIG. 4E.

In recent years, electronic devices have come to be driven by smaller and smaller voltages. Meanwhile, the element size of the data output switches Hsw is also becoming smaller, resulting in smaller peak inverse voltage. Therefore, it is not desirable to place a higher load on the switch Hsw because a higher load leads to degradation or the like of the switch Hsw, and to degradation of the display quality.

To this end, in the embodiment, change alleviating voltage output switches Msw are provided, as shown in FIG. 1, which are controlled when the opposing electrode voltage is changed during a non-display period. In this manner, the data lines 22 can be actively fixed to a predetermined voltage (VM) when the opposing voltage is changed, that is, the data lines 22 are electrically connected to a predetermined power supply voltage, so that the voltage change in the data lines is alleviated. Although the load to the switches Hsw can be reduced while the voltage signal (change alleviating voltage) VM is at any level within the amplitude range of the display data, by setting the voltage to be at the video center voltage Vc, it is possible to inhibit changes in the potential of the data lines 22 without applying a DC component voltage to the liquid crystal.

Figure 4C:
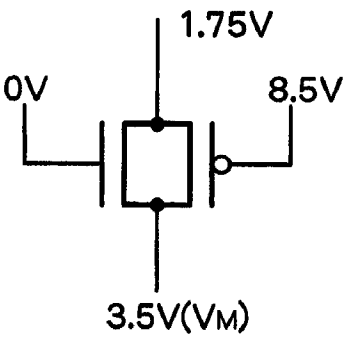
Figure 4D:
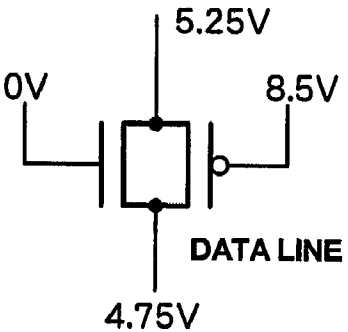
Figure 4E:
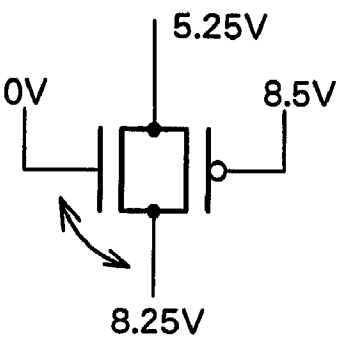
Figure 4F:
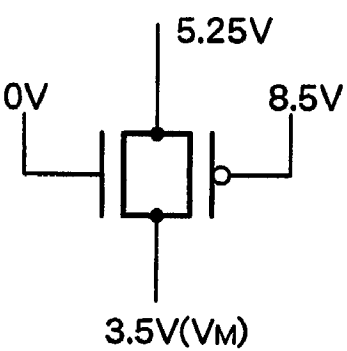

FIGS. 4C and 4F show respectively the conditions of the switch Hsw when a video center voltage Vc (3.5 V) is applied while the opposing electrode voltage is changed. As isclear from these figures, by applying a video center voltage Vc, the reverse bias voltage loaded to the switch Hsw can be reduced even beyond the level when the opposing electrode voltage is not periodically inverted.

The change alleviating voltage can be applied either before or after the changing timing of the opposing electrode voltage during the non-display period, but, in order to minimize the duration when a large reverse bias voltage is applied to the switch Hsw, it is desirable that the interval between the changing timing of the opposing electrode voltage and the application timing of the change alleviating voltage be set as short as possible. Also, in order to further reduce the potential changes on the data line 22, it is desirable that the data line 22 be electrically floating when the opposing electrode voltage is changed. Therefore, it is preferable that the opposing electrode voltage be changed during the period of application of the change alleviating voltage VM to the data line 22.

Figure 5:
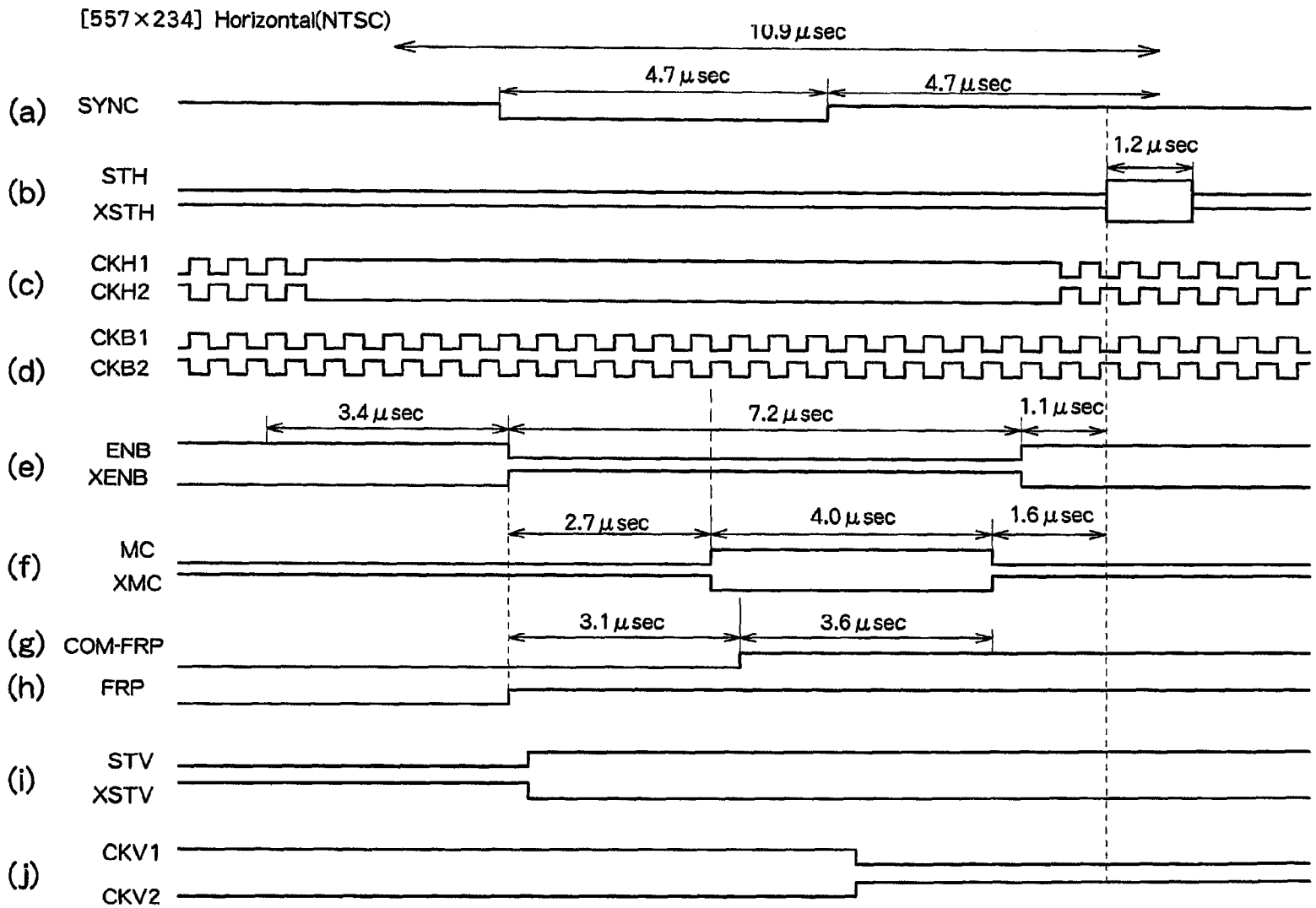
FIG. 5 is a timing chart of each of control signals near a horizontal return period.

An example of control of the application timing of the change alleviating voltage and the inversion timing of the opposing electrode signal will now be described referring to the timing chart of FIG. 5. FIG. 5 shows an example of a timing chart for each of the control signals generated by the T/C 160 shown in FIG. 2 for controlling the display panel, around an H return period.

First, the T/C 160 comprises an H counter and counts CKB1 or CKB2 shown in FIG. 5 (*d*) both of which are produced based on a master clock MCLK (not shown). When a horizontal synchronization signal of FIG. 5 (*a*) is detected (in this example, at the L level), the H counter is reset. A horizontal start pulse STH shown in FIG. 5 (*b*) (XSTH is the inverted signal of STH) is output to the H driver 220 of the panel 200 based on the count value of the H counter which is updated every 1H. FIG. 5 (*c*) shows a horizontal clock CKH1 (CKH2 is the inverted signal of CKH1) which is output to the H driver 220. When the horizontal start pulse STH is supplied to the H driver 220, the H driver 220 outputs a data line selection signal to the data output switch Hsw at the rise (or fall) of the horizontal clock CKH1. FIG. 5 (*h*) shows an inversion control signal FRP for inverting the polarity of the display data signal every 1H. Based on the inversion control signal FRP, the polarity of the display data signal supplied to each data line during one horizontal scan period is controlled.

FIG. 5 (*i*) shows a vertical start pulse STV (XSTV is the inverted signal of STV) which is output from the T/C 160 to the V driver 210 once every vertical period based on a vertical synchronization signal Vsync (not shown). The waveform shown in FIG. 5 (*j*) is a vertical clock CKV1 (CKV2 is the inverted signal of CKV1) which become H level (or L level) once every 1H.

FIG. 5 (*g*) shows an opposing voltage inversion control signal COMP-FRP for inverting the polarity of the opposing electrode voltage every 1H, similar to the display data signal.

When the vertical start pulse STV is supplied to the V driver 210, the V driver 210 outputs, at every rise (or fall) of the vertical clock CKV1, a gate signal (pixel selection signal) to the corresponding gate line 12, so that the pixel TFT 10 connected to the corresponding gate line 12 is controlled to be switched on. At the same time, the switch Hsw is controlled to be switched on and a display data signal is output from a video input line 24 onto the data line 22, which is then applied to the pixel electrode via the pixel TFT 10 in an ON state. As described above, the potential of the opposing electrode forming the liquid crystal capacity Clc along with the pixel electrode with the liquid crystal in between is controlled to be inverted every 1H. The alignment of the liquid crystal between the electrodes is thereby controlled by the potential on the opposing electrode at that time and the potential of the pixel electrode corresponding to the display data signal.

The operation during the display period is as described above. In contrast, during the non-display period (vertical blanking interval or horizontal blanking interval; in the example of the embodiment, horizontal blanking interval), an enable signal ENB as shown in FIG. 5 (*e*) (XENB is the inverted signal of ENB) is output to the V driver 210 and H driver 220 based on the count value of the master clock counted by the H counter from the output of the horizontal synchronization signals. The V driver 210 stops the output of gate signals to the gate lines 12 during a period when output is forbidden in the V driver 210 as instructed by the enable signal ENB. At the same time, the H driver 220 stops output of data line selection signals to the switches Hsw. Therefore, when the enable signal is being output, no display data signal is output onto the data lines 22 and no gate selection signal is output to the gate lines 12.

The enable signal ENB is output for a duration of, for example, 7.2 μsec, and the T/C 160 outputs an alleviation control signal MC as shown in FIG. 5 (*f*) (XMC is the inverted signal of MC) to the H driver 220 after a predetermined amount of time has elapsed (for example, 2.7 μsec) since the start of output of the enable signal ENB, based on the counter value by the H counter. The control signal MC is output for a duration of, for example, 4.0 μsec and is always completed before completion of the output period of the enable signal ENB. When the alleviation control signal MC is supplied to the H driver 220, the H driver switches to an ON state all of the alleviating voltage output switches Msw, each of which is provided between the VM line 26 onto which the change alleviating voltage signal VM is output and each of the data lines 22, as shown in FIG. 1. In this manner, when no gate line 12 is selected during the non-display period, that is, when all the pixel TFTs 10 are switched off, the alleviating voltage output switches Msw are switched on so that the alleviating voltage VM which is equal to the video center voltage Vc (for example, 3.5 V) is applied to each of the data lines 22.

In the example of the embodiment, the polarity of the opposing voltage inversion control signal COM-FRP shown in FIG. 5 (*g*) is inverted after the output of the enable signal ENB is started and after the alleviation control signal MC is output. After inversion of the opposing voltage inversion control signal COM-FRP, the switch 140 shown in FIG. 2 is switched, and the opposing electrode voltage is inverted. During this inversion, each of the data lines 22 is connected to the VM line 26 via a corresponding switch Msw, as described above. Therefore, even when the opposing electrode voltage is changed, the voltage on the data line 22 is less likely to change, and the reverse bias to the switches Hsw is reduced during the opposing voltage change, as shown in FIGS. 4C and 4F.

What is claimed is:

1. A method for driving an active matrix type liquid crystal display, wherein in said active matrix type liquid crystal display, liquid crystal is sealed between a first substrate and a second substrate;

said first substrate comprises switching elements and pixel electrodes connected to said switching elements, both of which are provided in correspondence to pixels that are arranged in a matrix, selection lines for sequentially selecting said switching elements, and data lines for supplying display data to said switching elements that are connected; and said second substrate comprises an opposing electrode for controlling, in conjunction with each of said pixel electrodes on said first electrode, said liquid crystal, said method comprising:

periodically changing, in a predetermined period, an opposing electrode voltage, which is applied to said opposing electrode;

applying a change alleviating voltage to said data lines when said opposing electrode voltage is changed, wherein said change alleviating voltage is a predetermined voltage for alleviating a change in voltage on said data lines, which is independent from said display data;

setting a data line voltage on said data lines to said change alleviating voltage; and maintaining said data line voltage at said change alleviating voltage when said opposing electrode voltage changes through application of said change alleviating voltage on said data lines.

2. A driving method of an active matrix type liquid crystal display according to claim 1, wherein said change in said opposing electrode voltage and application of said change alleviating voltage to said data lines are performed during one or both of a vertical blanking interval and a horizontal blanking interval.

3. A driving method of an active matrix type liquid crystal display according to claim 2, wherein said change alleviating voltage is at a center voltage of said display data.

4. A driving method of an active matrix type liquid crystal display according to claim 1, wherein said change alleviating voltage is at a center voltage of said display data.

5. A method for driving an active matrix type liquid crystal display according to claim 1, wherein said switching element in each of said pixels is set at an off state while said opposing electrode voltage changes.

6. A method for driving an active matrix type liquid crystal display according to claim 1, wherein said switching element in each of said pixels is controlled to be switched off and a voltage of said data line is fixed at said change alleviating voltage while said opposing electrode voltage changes.

7. A method for driving an active matrix type liquid crystal display according to claim 1, wherein during a period when selection of said switching element in all pixels is prohibited and output of said display data to said data line is prohibited in response to an enable signal, said data line is fixed at said change alleviating voltage and said opposing electrode voltage is changed.

8. A method for driving an active matrix type liquid crystal display according to claim 7, wherein a fixed state of said data line at said change alleviating voltage is cancelled after said opposing electrode voltage is changed and before selection of said switching element and said output of display data to said data line are allowed upon completion of said output of said enable signal.

9. A method for driving an active matrix type liquid crystal display according to claim 1, wherein a polarity of said display data with respect to a predetermined reference is periodically inverted in a predetermined period.

10. A drive circuit for an active matrix type display, wherein in said active matrix type display, liquid crystal is sealed between a first substrate and a second substrate, said first substrate comprises switching elements and pixel electrodes connected to said switching elements, both of which are provided in correspondence to pixels that are arranged in a matrix, selection lines for sequentially selecting said switching elements, and data lines for supplying display data to said switching elements that are connected, and said second substrate comprises an opposing electrode for controlling, in conjunction with each of said pixel electrode on said first substrate, said liquid crystal, said drive circuit comprising:

an opposing electrode controller capable of periodically changing, in a predetermined period, an opposing electrode voltage which is applied to said opposing electrode; and a data line voltage controller capable of: applying a change alleviating voltage onto said data lines during said change in said opposing electrode voltage, wherein said change alleviating voltage is a predetermined voltage capable of alleviating a change in voltage on said data lines, which is set independent from said display data; setting a data line voltage on said data lines to said change alleviating voltage; and maintaining said data line voltage at said change alleviating voltage when said opposing electrode voltage changes through application of said change alleviating voltage on said data lines.

11. A drive circuit for an active matrix type display according to claim 10, wherein said change alleviating voltage is at a center voltage of said display data.

12. A method for driving an active matrix type liquid crystal display, wherein in said active matrix type liquid crystal display, liquid crystal is sealed between a first substrate and a second substrate;

said first substrate comprises switching elements and pixel electrodes connected to said switching elements, both of which are provided in correspondence to pixels that are arranged in a matrix, selection lines for sequentially selecting said switching elements, and data lines for supplying display data to said switching elements that are connected; and said second substrate comprises an opposing electrode for controlling, in conjunction with each of said pixel electrodes on said first electrode, said liquid crystal, said method comprising:

periodically changing, in a predetermined period, an opposing electrode voltage to said opposing electrode;

applying a change alleviating voltage onto said data line, during a period when output of a selection signal for said switching element in said pixel is stopped and output of said display data onto said data line is stopped, wherein said change alleviating voltage is a predetermined voltage capable of alleviating a change in voltage on said data lines, which is independent from said display data;

setting a data line voltage on said data lines to said change alleviating voltage; and maintaining said data line voltage at said change alleviating voltage when said opposing electrode voltage changes through application of said change alleviating voltage on said data lines.

13. A drive circuit for an active matrix type liquid crystal display, wherein in said active matrix type liquid crystal display, liquid crystal is sealed between a first substrate and a second substrate, said first substrate comprises switching elements and pixel electrodes connected to said switching elements, both of which are provided in correspondence to pixels that are arranged in a matrix, selection lines for sequentially selecting said switching elements, and data lines for supplying display data to said switching elements that are connected, and said second substrate comprises an opposing electrode for controlling, in conjunction with each of said pixel electrodes on said first substrate, said liquid crystal, said drive circuit comprising:

a vertical scan driver which outputs a selection signal to said selection line at a predetermined timing;

a horizontal scan driver which outputs display data to said data line at a predetermined timing;

an opposing electrode controller capable of periodically changing, in a predetermined period, an opposing electrode voltage which is applied to said opposing electrode;

a data line voltage controller capable of applying a change alleviating voltage onto said data lines during said change in said opposing electrode voltage, wherein said change alleviating voltage is a predetermined voltage capable of alleviating a change in voltage on said data lines, which is independent from said display data; setting a data line voltage on said data lines to said change alleviating voltage; and maintaining said data line voltage at said change alleviating voltage when said opposing electrode voltage changes through application of said change alleviating voltage on said data lines; and a timing controller which receives a clock signal and a synchronization signal and generates an enable signal, an alleviation control signal which is output after a predetermined period after output of said enable signal, and a change control signal capable of changing said opposing electrode voltage, wherein said vertical scan driver stops output of said selection signal based on said enable signal;

said horizontal scan driver stops output of said display data based on said enable signal;

said data line voltage controller applies said change alleviating voltage onto said data line based on said alleviation control signal; and said opposing electrode controller changes said opposing electrode voltage based on said change control signal.

14. A drive circuit for an active matrix type liquid crystal display according to claim 13, wherein said timing controller completes said output of said alleviation control signal before said output of said enable signal is complete.

* * * * *